United States Patent [19]

Yamamoto

[11] 4,076,870

[45] Feb. 28, 1978

[54] PROCESS FOR TREATING FIBROUS PRODUCTS CONTAINING CELLULOSIC FIBERS

[75] Inventor: Kazuhide Yamamoto, Uji, Japan

[73] Assignee: Daido-Maruta Finishing Co. Ltd., Kyoto, Japan

[21] Appl. No.: 726,955

[22] Filed: Sep. 27, 1976

[30] Foreign Application Priority Data

Oct. 1, 1975 Japan ..... 50-117636
Oct. 1, 1975 Japan ..... 50-117637

[51] Int. Cl.[2] ..... D06M 1/00; D06M 13/34; D05D 3/02

[52] U.S. Cl. ..... 427/390 C; 8/115.6; 8/116 R; 8/181; 8/182; 427/394

[58] Field of Search ..... 8/115.6, 115.7, 116.2, 8/116.3, 120, 129, DIG. 2, 116 R, 181, 182; 427/390 C, 394

[56] References Cited

U.S. PATENT DOCUMENTS

| | | | |
|---|---|---|---|
| 2,872,428 | 2/1959 | Schroeder | 427/390 X |
| 2,898,238 | 8/1959 | Van Loo et al. | 427/390 X |
| 3,190,715 | 6/1965 | Gordon | 427/390 X |
| 3,407,026 | 10/1968 | Mauldin | 8/115.6 |
| 3,720,500 | 3/1973 | Gale | 8/115.7 |

*Primary Examiner*—Michael R. Lusignan
*Attorney, Agent, or Firm*—Sherman & Shalloway

[57] ABSTRACT

A process for modifying a fibrous product containing cellulosic fibers, which comprises impregnating said fibrous product with a treating liquor containing a chemical textile finishing agent, and then heat-treating the impregnated fabric in the presence of an acid catalyst which comprises a fluorocarboxylic acid of the formula $$C_nF_pH_qCOOH$$

wherein $n$ is an integer of 1 to 5, $p$ is 2 to 10, and $q$ is 0 or 1, with the proviso that the sum of $p$ and $q$ equals $2n + 1$. The fibrous product thus treated has markedly improved shrinkage resistance, dry crease resistance, wet crease resistance and wash and wear properties while retaining mechanical strength characteristics.

11 Claims, No Drawings

PROCESS FOR TREATING FIBROUS PRODUCTS CONTAINING CELLULOSIC FIBERS

This invention relates to a process for modifying fibrous products containing cellulosic fibers, and more particularly, to a process for modifying cellulosic fiber-containing fibrous products using a novel catalyst to greatly improve their shrinkage resistance, dry crease resistance, wet crease resistance and wash and wear properties while retaining their mechanical strength characteristics such as tear strength, tensile strength, or flex abrasion resistance at high levels.

Fibrous products containing cellulosic fibers have superior physical strength characteristics such as tear strength, flex abrasion strength or tensile strength, but have the defect that when washed, they shrink considerably in the warp and filling directions, and they also have poor dry and wet crease resistances and wash and wear properties.

Various methods have therefore been proposed previously with a view to improving the wash shrinkage resistance, dry crease resistance, wet crease resistance and wash and wear properties of the cellulosic fibrous products, but the only feasible method now in commercial use is an aminoplast resin finishing method which comprises impregnating a cellulosic fiber-containing fibrous product with an N-methylol compound or its functional derivative such as dimethylol glyoxal monoureine in the presence of an acid catalyst, and then heat-treating the fibrous product.

Such a conventional method using an N-methylol compound or its functional derivative can give rise to a considerable improvement in shrinkage resistance and dry and wet crease resistances, but suffers from the serious defect that this resin finishing, on the other hand, results in a marked reduction in physical strengths such as tear strength, flex abrasion strength and tensile strength which the cellulosic fibrous products inherently possess.

A report was recently made in Chemical Engineering, Mar. 17, 1975 that a metal chloride (e.g., magnesium chloride) used very preferably heretofore as the acid catalyst in the aminoplast resin finishing method, upon reaction with formaldehyde, forms bis-chloromethyl ether (substances whose manufacture is prohibited by Labor Safety and Sanitation Law of Japan, Article 55) which is carcinogenic. Accordingly, the use of an acid catalyst such as a metal chloride must be avoided also in the treatment of cellulosic fiber-containing fibrous products using an N-methylol compound which will generate formaldehyde.

The present inventor previously suggested a method for resin finishing of cellulosic fabrics which comprises treating the fabrics in the presence of an acid catalyst with a solution containing an N-methylol compound and a copolymer derived from a glycidyl-containing vinyl monomer and another vinyl monomer, in an attempt to get over the disadvantage of strength reduction (Japanese Laid Open Patent Application No. 36793/75).

In addition, according to the above conventional finishing method, formaldehyde is freed during the finishing treatment. The free formaldehyde not only pollutes the environment of the site of finishing operation, but also causes dermal troubles such as irritation, rash and blister and gives off an uncomfortable odor as a result of remaining in the cellulosic fibrous products treated. This has posed a problem of "apparel pollution". In Japan, a legislative control of the formaldehyde content of household goods has already been established from the standpoint of sanitation (Law No. 112 Relating to the Regulation of Household Goods Containing Hazardous Substances), and it is expected that the resin finishing of textile articles with formaldehyde-containing treating agents will also be legislatively prohibited in near future.

Resin finishing of cellulosic fibrous products is essential for saving a trouble of ironing and providing fibrous articles, particularly wearing apparel, which do not cause creases for long periods of time.

With this background, a "formalin-free" method of resin finishing was already proposed in which cellulosic fiber-containing fibrous products are treated with certain imidazolidinone derivatives in the presence of acid catalyst, and then heat-treating the fibrous product.

The further investigation of these various treating methods led to the discovery that differences in the type of acid catalyst used result in considerable differences in the quality and emitted odor of the cellulosic fibrous product treated.

Heretofore, magnesium chloride, zinc nitrate, zinc chloride, zinc borofluoride, magnesium biphosphate, ammonium chloride, ammonium nitrate, monoethanolamine hydrochloride, diethanolamine hydrochloride, acetic acid, and trichloroacetic acid, for example, have been used as the acid catalyst. For example, when a relatively mild acid catalyst such as magnesium chloride is used, fibrous products treated by the above methods have a relatively low degree of strength reduction, but such a metal chloride, when used in combination with the N-methylol compound, is extremely likely to yield carcinogenic bis-chloromethyl ether. Furthermore, when the metal chloride is used together with the imidazolidinone derivative to treat a fibrous product, a bad odor such as amine odor or garlic odor is given off from the treated product.

The use of a metal-free organic acid catalyst such as acetic acid can give rise to some improvement in the crease resistances and wash and wear properties of the treated fibrous products, but undesirably causes great reduction in strength.

When zinc borofluoride is used, offensive odors are reduced as compared with the case of using magnesium chloride, and the crease resistances and wash and wear properties of the treated fibrous products are considerably improved. But this method has the defect that there is a considerable reduction in the strength of the treated fibrous product.

The use of trichloroacetic acid suffers from the defect that it is decomposed during heat-treatment to give off an irritating odor, and the strength of the treated fibrous product is greatly reduced.

The inventor therefore made extensive investigations in an attempt to avoid the use of the above-mentioned metal chloride-type latent acid catalysts, and to provide acid catalysts which can impart superior shrinkage resistance, crease resistance and wash and wear properties to fibrous products without an appreciable reduction in the strength of the treated product and without the generation of offensive odors such as amine odor, garlic odor, or irritating odor. As a result, it was found that certain types of fluorocarboxylic acids are very suitable as such acid catalysts.

According to the present invention, there is provided a process for modifying a fibrous product containing cellulosic fibers, which comprises impregnating the fibrous product with a treating liquor containing a chemical textile-finishing agent, and then heat-treating it in the presence of, as an acid catalyst, a fluorocarboxylic acid of the formula $$C_nF_pH_qCOOH \quad (I)$$

wherein $n$ is an integer of 1 to 5, particularly 1 to 3, $p$ is 2 to 10, particularly 2 to 6, and $q$ is 0 or 1, with the proviso that the sum of $p$ and $q$ equals $2n + 1$.

In order to improve the wash shrinkage, dry and wet crease resistances and wash and wear properties of fibrous products containing cellulosic fibers, it has been common practice in the art to subject the products to a finishing treatment referred to as resin finishing.

The resin finishing usually comprises impregnating a cellulosic fibrous product with a treating liquor containing a chemical textile finishing agent which has an active group crosslinkable with the hydroxyl groups of the cellulose, and heat-treating the fibrous product in the presence of an acid catalyst to achieve crosslinking between the cellulose and the finishing agent.

The present invention is essentially characterized by using the specified fluorocarboxylic acids of formula (I) as acid catalysts in the resin finishing method.

Suitable fluorocarboxylic acids of formula (I) that can be used in the invention are $CF_3COOH$, $CF_2HCOOH$, $C_2F_5COOH$, $C_2F_4HCOOH$, $C_3F_7COOH$, $C_3F_6HCOOH$, $C_4F_9COOH$, $C_4F_8HCOOH$, $C_5F_{11}COOH$, and $C_5F_{10}HCOOH$. Of these, trifluoroacetic acid is especially preferred. They can be used either alone or in admixture of two or more.

Since the fluorocarboxylic acid performs a catalytic action in a crosslinking reaction between the chemical finishing agent and the cellulose in the cellulosic fibrous product in the heat-treating step, it can be applied to the fibrous product in any desired step before the heat-treatment step so long as it is present on the fibrous product in the heat-treating step.

Generally, it is advantageous to apply the fluorocarboxylic acid to the fibrous products in the form of a solution or dispersion in a liquid medium, particularly water. It is especially preferred to include the fluorocarboxylic acid into the treating liquor containing a chemical textile-finishing agent. Accordingly, the following description refers to the case where the fluorocarboxylic acid is present in the treating liquor. It should be understood however that the invention is not limited to this specific embodiment.

The amount of the fluorocarboxylic acid to be used is not strictly limited, but can be varied over a wide range according, for example, to the type or concentration of the chemical textile-finishing agent used, the type of the fibrous product to be treated, and the treating conditions. Generally, it can be used in an amount of 0.01 to 1.5% by weight, preferably 0.05 to 0.5% by weight, based on the weight of the treating agent containing the chemical textile-finishing agent, and is 0.05 to 15% by weight, especially 0.1 to 10% by weight, based on the weight of the chemical textile finishing agent.

If desired, the fluorocarboxylic acid catalyst in accordance with this invention can be used in conjunction with conventional acid catalysts other than the metal chloride-type acid catalysts, which have frequently been used in the resin finishing of cellulosic fibrous products. Examples of the other acid catalysts are zinc nitrate, magnesium nitrate, magnesium biphosphate, zinc borofluoride, magnesium borofluoride, ammonium nitrate, acetic acid, and zinc stearate. In this case, the other acid catalysts can be used in smaller amounts than those used previously, and therefore the defects of the conventional methods can be drastically reduced. The amount of the conventional acid catalyst is about 0.05 to 1.5% by weight based on the weight of the treating liquor.

The process of the present invention can be performed in accordance with the known resin finishing method for cellulosic fibrous products except that an acid catalyst comprising the fluorocarboxylic acid of formula (I) is used as the acid catalyst.

In the present application, the term "chemical textile-finishing agents" denotes low-molecular-weight or high-molecular-weight substances which contain at least one reactive group or radical such as an active hydroxyl group, aldehyde group or epoxy group which can be chemically bonded to the hydroxyl groups of the cellulose in the fibrous product at an elevated temperature under acidic conditions, and includes all chemical finishing agents which have heretofore been used for resin finishing of cellulosic fibrous products. For example, substances disclosed in M. W. Ranney, "Crease Proofing Textiles" (1970) (Noyes Data Corp., New Jersey, U.S.A.), and H. Mark, Norman S. Wooding and Sheldon M. Atlas, "Chemical Aftertreatment of Textiles" can be used in this invention.

Typical examples of suitable chemical textile-finishing agents for use in this invention are given below.

A. N-methylol compounds and derivatives thereof:

The N-methylol compounds used in the present invention mean nitrogen-containing compounds containing at least one active methylol group (—$CH_2OH$) in the molecule which are obtained by a condensation reaction between nitrogen-containing organic compounds, particularly amino compounds or amide compounds, or nitrogen-containing heterocyclic compounds and formaldehyde. They may be in the form of monomer, dimer or a precondensate or polymer. Typically, the N-methylol compounds include compounds used in the production of amino resins or resins called aminoplasts. Examples of these compounds are N-methylol derivatives of nitrogen-containing compounds which may be urea compounds such as urea, ethyleneurea, propyleneurea, dihydroxyethyleneurea or acetylenediurea, thiourea compounds such as thiourea or ethylenethiourea, guanidine compounds such as guanidine nitrogen-containing heterocyclic compounds such as melamine, triazine, triazone, urone or glyoxal monoureine, carbamic acid esters such as methyl carbamate, ethyl carbamate or propyl carbamate, carbamates such as methyl carbamate; and amides such as acrylamide or methacrylamide. Methylol derivatives such as melamine, triazone or glyoxal monoureine are preferred. Amino resin-forming precondensates such as a urea-formaldehyde precondensate or a melamine-formaldehyde precondensate are also preferred.

The functional derivatives of N-methylol compounds preferably include, for example, alkyl ether derivatives of the above N-methylol compounds, particularly reaction products formed between N-methylol compounds and lower alcohols such as methanol, ethanol, butanol or isopropanol (e.g., dimethylolurea dimethylol ether, trimethoxymethylol melamine, or dimethoxymethylol glyoxal monoureine), and acyl-substitution products of N-methylol compounds such as 1,3-dimethylol-4-acetyl-5-hydroxyethyleneurea.

N-methylol compounds of the following formula

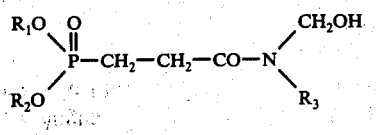

wherein $R_1$ and $R_2$ represent an alkyl group containing up to 5 carbon atoms, and $R_3$ represents a hydrogen atom or a methylol group, widely used as fire-retarding agents, and N-methylol derivatives of long-chain alkylcarboxylic acid amides, such as an N-methylol derivative of steramide, frequently used as water-repellents or hand improvers can also be used in the process of this invention.

Furthermore, polymeric N-methylol compounds can also be used in the process of this invention. Examples are partially methylolated products of polyacrylamide or copolymers of acrylamide and other vinyl monomers.

These N-methylol compounds and their derivatives can be used either alone or in combination of two or more.

B. Imidazolidinone derivatives:

Imidazolidinone derivatives of the following formula

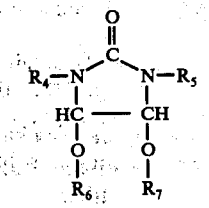

(III)

wherein $R_4$ and $R_5$, independently from each other, represent a hydrogen atom, an alkyl group, or an alkyl group substituted with a hydroxyl, cyano, carboxyl, lower alkoxy carbonyl or carbamoyl group, and $R_6$ and $R_7$, independently from each other, represent an alkyl or acyl group.

In formula (I), the alkyl groups represented by $R_1$, $R_2$, $R_3$ and $R_4$ may be of straight chain or branched chain, and for example, include methyl, ethyl, n- or isopropyl, n-, iso-, sec- or tert-butyl, n- or neo-pentyl, and n-hexyl. Alkyl groups containing 1 to 5 carbon atoms are preferred. A methyl group is especially preferred for $R_4$ and $R_5$, and an iso-propyl group, for $R_6$ and $R_7$. The alkyl groups substituted with a hydroxyl, cyano, carboxyl, lower alkoxy carbonyl, or carbamoyl group (represented by $R_4$ and $R_5$) are preferably those containing 2 to 5 carbon atoms, such as 1- or 2-hydroxyethyl, 1-, 2-, or 3-hydroxypropyl, 4-hydroxybutyl, 2-cyanoethyl, 2-carboxyethyl, 3-ethoxycarbonyl ethyl, and 2-carbamoylethyl. The acyl groups represented by $R_6$ and $R_7$ mean carboxylic acid residues of the formula $R_8CO$— in which $R_8$ represents an allyl or aralkyl group, and include, for example, alkanoyl groups containing 1 to 5 carbon atoms such as acetyl, propionyl, or phenylacetyl, the acetyl being especially preferred.

Examples of suitable imidazolidinone derivatives of formula (III) are 4,5-dihydroxy-2-imidazolidinone, 1,3-dimethyl-4,5-dihydroxy-2-imidazolidinone, 1,3-diethyl-4,5-dihydroxy-2-imidazolidinone, 1,3-n-propyl-4,5-dihydroxy-2-imidazolidinone, 1,3-di(α-hydroxyethyl)-4,5-dihydroxy-2-imidazolidinone, 1,3-di(β-hydroxyethyl)-4,5-dihydroxy-2-imidazolidinone, 1,3-dimethyl-4,5-dimethoxy-2-imidazolidinone, 1,3-dimethyl-4,5-diethoxy-2-imidazolidinone, 1,3-dimethyl-4,5-diisopropoxy-2-imidazolidinone, 1,3-dimethyl-4,5-diacetoxy-2-imidazolidinone, 1,3-di-(β-cyanoethyl)-4,5-diacetoxy-2-imidazolidinone, 1,3-di-(β-cyanoethyl)-4,5-dimethoxy-2-imidazolidinone, 1,3-di-(β-carbamoylethyl)-4,5-dihydroxy-2-imidazolidinone, 1,3-di-(β-carbamoylethyl)-4,5-dimethoxy-2-imidazolidinone, 1,3-di-(β-carboxyethyl)-4,5-dihydroxy-2-imidazolidinone, 1,3-di-(β-carboxyethyl)-4,5-dimethoxy-2-imidazolidinone, 1,3-di-(β-ethoxycarbonylethyl)-4,5-dihydroxy-2-imidazolidinone, and 1,3-di-(β-ethoxycarbonylethyl)-4,5-dimethoxy-2-imidazolidinone.

Of these, 4,5-dihydroxy-2-imidazolidinone, 1,3-dimethyl-4,5-dihydroxy-2-imidazolidinone, 1,3-dimethyl-4,5-diacetoxy-2-imidazolidinone, 1,3-dimethyl-4,5-diisopropyloxy-2-imidazolidinone, and 1,3-di-(β-hydroxyethyl)-4,5-dihydroxy-2-imidazolidinone are especially preferred for use in this invention.

C. Glycidyl-containing thermoplastic polymers:

Useful thermoplastic polymers are any thermoplastic polymers which are film-forming, have a glycidyl-containing pendant side chain, and can be formed into a solution or dispersion, especially emulsion. Preferably, they are copolymers derived from glycidyl-containing monoethylenically unsaturated monomers and other monoethylenically unsaturated monomers copolymerizable therewith.

The glycidyl-containing monoethylenically unsaturated monomers are preferably of the glycidyl ester or glycidyl ether type, for example, compounds of the following formulae (IV) and (V), particularly the glycidyl estertype compounds of formula (V).

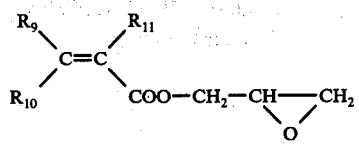

(IV)

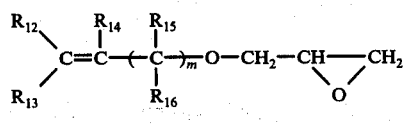

(V)

In the above formulae (IV) and (V), $R_9$, $R_{10}$, $R_{11}$, $R_{12}$, $R_{13}$, $R_{14}$, $R_{15}$, and $R_{16}$ each represent a hydrogen atom or a substituent that does not participate in polymerization reactions, preferably a halogen atom such as chlorine, fluorine or bromine, or an alkyl group such as methyl or ethyl, and $m$ is 0 or 1. Where these groups $R_1$ through $R_{16}$ represent a halogen atom, the resulting polymers are rendered fire-retardant, and are therefore suitable for fire-retarding applications.

Examples of the glycidyl esters of formula (V) are glycidyl acrylate, glycidyl methacrylate, β,β-dichloroglycidyl acrylate, and glycidyl crotonate, the glycidyl acrylate and glycidyl methacrylate being especially preferred.

Examples of the glycidyl ethers of formula (V) include allyl glycidyl ether, and vinyl glycidyl ether, the former being especially preferred.

The aforementioned glycidyl-containing monoethylenically unsaturated monomers can be used either alone or in combination of two or more.

The other monoethylenically unsaturated monomers copolymerizable with the above glycidyl-containing monoethylenically unsaturated monomers are compounds containing one ethylenically unsaturated bond copolymerizable with the glycidyl-containing monomer in the molecule, and include, for example, monoolefins such as ethylene or propylene, vinyl monomers such as vinyl chloride, vinylidene chloride or acrylonitrile, acrylic acid, and derivatives of acrylic acid. Preferably, they are compounds expressed by the following formulae (VI) and (VII).

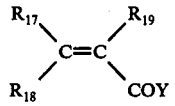

(VI)

wherein $R_{17}$ and $R_{18}$ each represent a hydrogen atom, or a substituent that does not participate in copolymerization reactions, preferably a halogen atom such as chlorine, fluorine or bromine, an alkyl group, especially an alkyl group containing 1 to 4 carbon atoms, or a carboxyl group; $R_{19}$ represents a hydrogen atom or a substituent that does not affect copolymerization reactions, for example, an alkyl group, particularly an alkyl group containing 1 to 4 carbon atoms, a hydroxyalkyl group, preferably a hydroxyalkyl group containing 1 to 4 carbon atoms, a carboxy-lower alkyl group, or a halogen atom; and Y is the group $OR_{20}$, in which $R_{20}$ represents a hydrogen atom, an alkyl group, particularly an alkyl group containing up to 18 carbon atoms, particularly 1 to 8 carbon atoms, a hydroxyalkyl group, particularly a hydroxyalkyl group containing 1 to 4 carbon atoms, or a di-lower alkyl amino-alkyl group, or an amino group optionally mono- or di-substituted with a lower alkyl group or a lower alkoxy lower alkyl group.

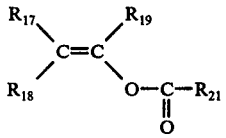

(VII)

wherein $R_{17}$, $R_{18}$ and $R_{19}$ are the same as defined hereinabove, and $R_{21}$ represents an alkyl group, particularly an alkyl group containing 1 to 4 carbon atoms.

Examples of the compounds of formula (VI), without any intention of limiting the scope of the present invention, are free carboxylic acids such as acrylic acid, methacrylic acid, itaconic acid, maleic acid, or crotonic acid; esters such as methyl acrylate, ethyl acrylate, butyl acrylate, octyl acrylate, methyl methacrylate, ethyl methacrylate, butyl methacrylate, 2-hydroxyethyl acrylate, 2-hydroxyethyl methacrylate, tridecyl methacrylate, stearyl methacrylate, cyclohexyl methacrylate, tetrahydrofurfuryl methacrylate, dimethylaminoethyl methacrylate, or diethylaminoethyl methacrylate; and amides such as acrylamide, methacrylamide, N,N-dimethyl acrylamide, N,N-diethyl acrylamide, N-methylol acrylamide, N-methylol methacrylamide, N-methoxymethyl acrylamide, and N-ethoxymethyl methacrylamide.

Examples of the compounds of formula (VII) include vinyl acetate and vinyl propionate.

Of these compounds of formula (VI) and (VII), preferred species are those of the following formulae (VIII) and (IX), particularly the former.

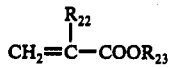

(VIII)

wherein $R_{22}$ represents a hydrogen atom or a methyl group, and $R_{23}$ is an alkyl group containing 1 to 18 carbon atoms.

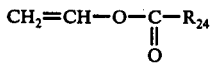

(IX)

wherein $R_{24}$ represents an alkyl group containing 1 to 8 carbon atoms, especially 1 to 3 carbon atoms.

The above exemplified monoethylenically unsaturated monomers can be used alone. In this case, the use of acrylic acid or acrylic acid ester of formula (VIII) and vinyl esters of carboxylic acids of formula (IX) is preferred. Or the above monoethylenically unsaturated monomers can be used in combination of two or more. In this case, combinations of compounds of formula (VIII) or (IX) with each other, or combinations of the compounds of formula (VIII) or (IX) with other compounds included within the definition of (VI) or (VII) which contain a functional group (e.g., a free carboxyl group, a hydroxyl group, an amino group, or an amide group) may be used to provide self-crosslinked copolymers.

The copolymerization of the glycidyl-containing monoethylenically unsaturated monomers and the other monoethylenically unsaturated monomers copolymerizable therewith can be performed by various known methods, such as emulsion polymerization, solution polymerization, or suspension polymerization.

The emulsion polymerization method is preferred because, for example, it can afford copolymers having a high molecular weight, and the resulting copolymer emulsions can be used directly as a textile treating liquor. The emulsion polymerization is performed, for example, by mixing a catalyst such as potassium persulfate, an emulsifier such as polyoxyethylene nonyl phenol ether or polyoxyethylene lauryl ether, the glycidyl-containing monoethylenically unsaturated monomer and the other monoethylenically unsaturated monomer with deionized water with stirring to form an emulsion of the monomeric mixture, heating a part of the emulsion to a temperature of at least 50° C in an inert atmosphere to initiate the polymerization, and continuing the polymerization while adding the remainder of the emulsion dropwise.

In any case, the copolymerization is desirably carried out under conditions which do not substantially decompose the glycidyl groups in the monomers and the resulting copolymer.

Advantageously, the resulting glycidyl-containing thermoplastic polymer contains 1 to 55 mole%, preferably 5 to 50 mole%, more preferably 10 to 40 mole%, of at least one structural unit derived from the glycidyl-containing monoethylenically unsaturated monomer and 99 to 45 mole%, preferably 95 to 50 mole%, more preferably 90 to 60 mole%, of at least one structural unit derived from the other monoethylenically unsaturated monomer, and if desired, up to 10 mole%, preferably not more than 5 mole%, of an additional structural unit derived from another copolymerizable vinyl monomer.

Examples of suitable other vinyl monomers for use in preparing the additional structural unit include ethylenically unsaturated carboxylic acids such as itaconic acid, crotonic acid and maleic acid; ethylenically unsaturated carboxylic acid amides such as acrylamide, methacrylamide, N,N-dimethyl acrylamide or N,N-diethyl methacrylamide; unsaturated nitriles such as acrylonitrile; and styrene, α-methylstyrene, vinyltoluene, vinyl acetate, and vinyl chloride. Of these, itaconic acid, crotonic acid, acrylamide, methacrylamide, and acrylonitrile are especially suitable.

The thermoplastic polymers that can be used in the process of this invention desirably have a glass transition temperature of not more than 30° C. preferably not more than 20° C, more preferably 0° to −70° C.

The "glass transition temperature", as used herein, denotes the temperature at which a polymer changes from a state of flexible rubber to a state of brittle glass, or vice versa, and which is at the inflection point of a Young's modulus-temperature curve of a film prepared from the polymer.

The thermoplastic polymer should desirably have an epoxy equivalency of generally 250 to 15,000, preferably 400 to 4,000.

The "epoxy equivalency", as used herein, denotes the weight in grams of the polymer per gram equivalent of epoxy group.

Thermoplastic polymers that can be used in the process of this invention are substantially linear high-molecular-weight polymers in which the introduced glycidyl groups substantially remain as pendant side chains, and which are film-forming.

These polymers advantageously have a molecular weight, measured by the method to be described hereinbelow, of at least 10,000, preferably at least 30,000, more preferably at least 50,000. There is no upper limit to the molecular weight so long as the polymers are film-forming. Generally, polymers of high molecular weights of any extent can be used if they can be maintained in an emulsion state.

D. Other chemical finishing agents:

1. Formalin and tetraoxane

2. Acetal compounds of the following formula $$H(OR_{22})_rO\text{-}R_{23}\text{—}O\text{—}(R_{22}O)_rH \quad (X)$$

wherein $R_{22}$ represents an alkylene group containing 2 or 3 carbon atoms, $R_{23}$ represents an alkylene group containing 1 to 3 carbon atoms, and $r$ is an integer of 1 to 12.

Examples of the acetal compounds are an acetalized product of diethylene glycol and an acetalized product of triethylene glycol.

3. Phosphorus-containing compounds of the following formulae:

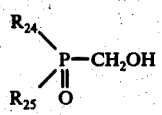
(XI)

wherein $R_{24}$ and $R_{25}$ represent a methyl or ethyl group;

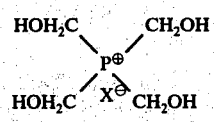
(XII)

wherein $X^-$ represents a halogen ion or $OH^-$.

Specifically, they are tetrahydroxymethyl phosphonium chloride, and tetrahydroxymethyl phosphonium hydroxide.

4. Epoxy group-containing compounds of the following formula:

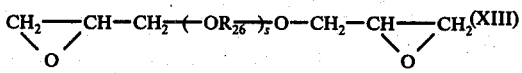
(XIII)

wherein $R_{26}$ represents a ethylene or propylene group, and $s$ is an integer of 1 to 23.

Specific examples of the epoxy group-containing compounds are ethylene glycol diglycidyl ether, triethylene glycol diglycidyl ether, and 1,3-glyceryl diglycidyl ether.

The above-exemplified chemical finishing agents may be used alone or in combination of two or more. When they are used in combination, combinations of the N-methylol compounds or functional derivatives thereof with the glycidyl-containing thermoplastic polymers, and combinations of the imidazolidinone derivatives with the glycidyl-containing thermoplastic polymers are advantageous.

In treating cellulosic fibrous products with these chemical textile finishing agent, the finishing agent is generally applied in a solution or dispersion in a liquid medium. Water is most preferred as the solvent or dispersing medium, but organic solvents, for example, alcohols such as methanol, ethanol or isopropanol, ketones such as acetone, methyl ethyl ketone, or methyl isobutyl ketone, amides such as dimethyl formamide or formamide, and ethers such as dioxane or tetrahydrofuran, and mixtures of water and these water-miscible organic solvents can also be used.

The concentration of the finishing agent in the treating liquor can be varied over a wide range according, for example, to the type of the finishing agent, the type and utility of the fibrous product to be treated, and the treating conditions. For example, the concentration based on the weight of the treating liquor is 1 to 30% by weight, preferably 5 to 20% by weight, for N-methylol compounds, their functional derivatives, and imidazolidinone derivatives, and 0.1 to 70% by weight, preferably 1 to 50% by weight, for glycidyl-containing polymers. More specifically, the concentration is advantageously 0.5 to 10% by weight, particularly 1 to 6% by weight, for treating woven or knitted fabrics, and 5 to 70% by weight, preferably 10 to 60% by weight, for treating non-woven fabrics.

Generally, the pH of the treating liquor is desirably not more than 7, usually, 1.0 to 6.5, preferably 1.5 to 5, and more preferably 3 to 4.5.

The pH adjustment of the treating liquor can be performed by adding pH adjusters and/or buffer solutions to the treating liquor. Examples of such pH adjusters and buffers are disclosed in a Japanese-language publication "Manual of Chemistry", pages 1096 to 1099 (1958), edited by the Japanese Chemical Society and published by Maruzen Co., Ltd.

If desired, the treating liquor in accordance with this invention may contain conventional textile finishes such as softening agents, water repellents, oil repellents, penetrants, bath stabilizers, and hand improvers.

The treating liquor so prepared is applied to cellulosic fibrous products by any conventional methods such as dipping, padding, spraying, or coating.

The pickup of the treating liquor in the cellulosic fibrous products can be varied freely over a wide range depending upon the concentration of the treating liquor and the type of the fibrous product, etc. Generally, the pickup is 30 to 300%, preferably 50 to 150%, based on the weight of the fibrous product before treatment.

The fibrous product to which the treating liquor has been applied is then pre-dried to remove the solvent or dispersing medium, and heat-treated at a temperature sufficient to induce a crosslinking reaction between the chemical finishing agent and the cellulose of the fibrous product in the presence of an acid catalyst. The pre-drying and heat treatment can be performed by the same operating procedures as in the conventional resin finishing process.

The pre-drying is carried out at a temperature of 80° to 120° C until the solvent or dispersing medium is removed substantially completely. The pre-drying can be carried out separately from the heat-treating step, or as a step immediately followed by the heat-treating step.

The heat-treating conditions can be varied over a wide range according, for example, to the types of the chemical finishing agent, the catalyst, and the fibrous product to be treated. Generally, the heat-treating temperature is at least 120° C but below a point at which the fibrous product is thermally degenerated, usually up to 190° C. Generally, temperatures of 130° to 180° C are advantageously employed.

The heat-treating time is affected by the heat-treating temperature, and generally, the time is short at high temperatures, and long at low temperatures. Generally, periods of 0.5 to 15 minutes are sufficient.

The fibrous products so heat-treated can be used directly in various applications, or can further be subjected to ordinary textile treatments such as softening, water repellant or oil repellent treatment, or hand improving treatment.

The cellulosic fibrous products that can be finished by the process of this invention include not only fibrous products (the term "fibrous products" denote not only woven and knitted fabrics, but also yarns, non-woven webs and non-woven fabrics) of natural fibers such as cotton or flax, regenerated cellulose fibers such as rayons, polynosic fibers, cellulose ester fibers or cellulose ether fibers, or mixtures of these, but also blend yarns, interwoven or interknitted fibrous products or non-woven fibrous webs composed of the above natural or regenerated cellulosic fibers and various synthetic fibers such as polyester, polyamide, acrylic, vinyl or benzoate type synthetic fibers.

Accordingly, the term "fibrous products containing cellulosic fibers", or "cellulosic fibrous products", as used in the present application, is meant to include all of the above-mentioned fibrous products.

Thus, according to the process of this invention, cellulosic fibrous products having markedly improved shrinkage resistance, dry and wet crease resistances and wash and wear properties can be obtained. In addition, the resulting fibrous products have far superior physical strengths such as tear strength, tensile strength and flex abrasion strength to fibrous products "resin-finished" with N-methylol compounds in accordance with the conventional methods. Furthermore, the process of this invention completely obviates the risk of forming bis(-chloromethyl) ether which is carcinogenic. These advantages render the process of this invention very significant in commercial operations.

Another advantage of the invention is that no offensive odors, such as amine odor, garlic odor or irritating odor occur.

The following Examples further illustrate the present invention.

Since the copolymers shown in the following Examples were not soluble in ordinary solvents, their molecular weights were determined by the following procedure. Using a chain transfer agent, a model copolymer of a low molecular weight is prepared from a monomeric mixture in the same molar ratio. The molecular weight of the resulting copolymer is measured by g3el permeation chromatography using poly(methyl methacrylate) of a known molecular weight as a reference. Then, the molecular weight of the copolymer actually obtained in each of the following Examples is determined by the extrapolation method.

Whether the glycidyl group was maintained undecomposed in the copolymer is confirmed by an oxirane oxygen analyzing method. In all of the copolymers used in the following Examples, the glycidyl groups were retained in a proportion of more than 90% of theory.

The properties of the fibrous products treated in the Examples were tested by the following methods.

1. Shrinkage on Washing

Measured in accordance with JIS L-1042 F-1in the case of knitted fabrics, and in accordance with JIS L-1042-D in the case of woven fabrics.

2. Dry Crease

Determined by the Monsanto method following JIS L-1041-1960.

3. Wet Crease

A sample is immersed in an aqueous solution containing 0.2% of a nonionic surface active agent at a temperature of 40° C for 15 minutes, and the excess of the aqueous solution is removed lightly using a filter paper. Then, the wet crease is measured by the above-mentioned Monsanto method.

4. Tensile Strength

Measured in accordance with the strip method in JIS L-1004. In the case of a knitted fabric, the sample is 2.5 cm wide and 10 cm long.

5. Wash and Wear Property

Measured in accordance with the method of AATCC-88A-94T-III C-2.

6. Amount of Residual Formaldehyde

Measured by the acetyacetone method described in Japanese Ministry of Welfare and Health Ordinance No. 34 based on Law No. 112.

7. Odor

After heat-treatment, the treated fibrous product is immediately placed in a polyethylene bag and the bag closed. After allowing the sample to stand overnight, three inspectors separately smell the product to examine the odor.

EXAMPLE 1

A 40-count cotton poplin woven fabric was dipped in each of the treating liquors I to IV shown below, withdrawn from the bath, squeezed to a pickup of 70% based on the weight of the fabric, pre-dried at 120° C for 3 minutes, and heat-treated at 160° C for 2 minutes.

| | |
|---|---|
| **Treating liquor I (invention)** | |
| Dimethylol glyoxal monoureine (50% aqueous solution) | 10% by weight |
| Acid catalyst (trifluoroacetic acid, 12.5% aqueous solution) | 4% by weight |
| Polyethylene emulsion (MEIKATEX PEN, a trademark for a product of Meisei Kagaku Kabushiki Kaisha) | 2% by weight |
| Water | remainder |
| **Treating liquor II (comparison 1)** | |
| Dimethylol glyoxal monoureine (50% aqueous solution) | 10% by weight |
| Metal salt catalyst (main ingredient: Magnesium chloride; ACCELERATOR MX, a trademark for a product of Sumitomo Chemical Co., Ltd.) | 3% by weight |
| Polyethylene emulsion (MEIKATEX PEN) | 2% by weight |
| Water | remainder |
| **Treating liquor III (comparison 2)** | |
| Dimethylol glyoxal monourein (50% aqueous solution) | 10% by weight |
| Acid catalyst (acetic acid, 80% aqueous solution) | 2% by weight |
| Polyethylene emulsion (MEIKATEX PEN) | 2% by weight |
| Water | remainder |
| **Treating liquor IV (comparison 3)** | |
| Dimethylol glyoxal monoureine (50% aqueous solution) | 10% by weight |
| Acid catalyst (trichloroacetic acid, 25% aqueous solution) | 2% by weight |
| Polyethylene emulsion (MEIKATEX PEN) | 2% by weight |
| Water | remainder |

The properties of the fabrics treated were measured, and the results are shown in Table 1.

Table 1

| Properties / Treating liquors | Crease resistance (warp + filling) Dry | Crease resistance (warp + filling) Wet | Tensile strength (kg/5 cm) | Wash and wear properties (grade) | Shrinkage on washing (%) Warp | Shrinkage on washing (%) Filling |
|---|---|---|---|---|---|---|
| Untreated | 165 | 163 | 31.5 | 1–1.5 | 2.7 | 3.4 |
| I (invention) | 275 | 228 | 20.9 | 4–4.5 | 0.1 | 0.2 |
| II (comparison 1) | 258 | 220 | 17.6 | 3–3.5 | 0.3 | 0.6 |
| III (comparison 2) | 215 | 200 | 16.3 | 1.5–2 | 2.4 | 2.9 |
| IV (comparison 3) | 237 | 214 | 16.8 | 2.5–3 | 1.7 | 1.4 |

It can be seen from Table 1 that the fabric treated with treating liquor I showed a marked improvement in crease resistance, wash and wear properties and shrinkage on washing and little reduction in strength. The fabric treated with the treating liquor of comparison 1 had markedly improved crease rsistance and wash and wear properties over the untreated fabric, but suffered from the defect that its strength was greatly reduced. In comparison 2, the strength of the treated fabric was greatly reduced, and its crease and shrinkage resistances were extremely poor. In comparison 3, the crease resistance and wash and wear properties of the treated fabric were somewhat improved, but its strength was greatly reduced and its shrinkage resistance was insufficient.

EXAMPLE 2

A mix-woven fabric consisting of 65% Tetoron polyester and 35% cotton was treated with each of treating liquor I, II, III and IV, and post-treated in the same way as in Example 1. The dry crease resistances (warp + filling) of the treated fabrics were 298°, 280°, 255° C and 268°, respectively. Before treatment, the fabric had a dry crease resistance of 250°.

EXAMPLE 3

A non-woven web made of 100% rayon with a basis weight of 60 g/m$^2$ was placed on a wire gauze-type belt, dipped in a treating liquor V shown below, squeezed to a pickup of 150% based on the weight of the web, pre-dried at 120° C for 4 minutes, and then heat-treated at 155° C for 3 minutes.

The resulting non-woven fabric had a dry crease resistance (warp + filling) of 295°.

The fabric so treated was washed at 60° C for 15 minutes in a home washer using a 0.2% aqueous solution of a household detergent (ZABU, a trademark for a product of Kao Soap Co., Ltd.) and its washing fastness was examined. There was no change in its dimension, and after washing, the fabric had a dry crease resistance (warp + filling) of 293° C.

| | |
|---|---|
| **Treating liquor V (invention)** | |
| Partially N-methylolated acrylic polymer (PRIMAL HA-8, a trademark for a product of Nippon Acryl Co., Ltd.) | 70% by weight |
| Acid catalyst (trifluoroacetic acid, 12.5% aqueous solution) | 3% by weight |
| Trimethylol melamine (SUMITEX RESIN M-3, a trademark for a product of Sumitomo Chemical Co., Ltd.) | 5% by weight |
| Water | remainder |

EXAMPLE 4

A cotton twill woven fabric was dipped in a treating liquor VI shown below, and post-treated in the same way as in Example 1.

| | |
|---|---|
| **Treating liquor VI (invention)** | |
| $(RO)_2O-\overset{\overset{O}{\|}}{C}H_2CH_2CONHCH_2OH$ PYROVATEX CP, a trademark for a product of Ciba-Geigy Company | 40% by weight |
| Acid catalyst (trifluoroacetic acid, 12.5% aqueous solution) | 4% by weight |
| Trimethylol malamine (SUMITEX RESIN M-3) | 3% by weight |
| Water | remainder |

The fire-retarding property of the resulting fabric was examined. It exhibited a very good fire retardancy expressed by a charred area of 25 cm$^2$. The treated fabric was soaped at 60° C for 30 minutes using an aqueous solution containing 0.1% of MONOGEN 170 (a trademark for a product of Daiichi Kogyo Yakuhin Kabushiki Kaisha) and 0.1% of soda ash, and again subjected to a fire-retardancy test. Its charred area was found to be 28 cm². It had very superior washing fastness.

The same fabric was treated in the same way as above except that the same amount of acetic acid (80% aqueous solution) was used as an acid catalyst instead of the trifluoroacetic acid in the treating liquor VI. The treated fabric was subjected to the same fire retardancy test, and found to have a charred area of 30 cm². After the same soaping treatment, the fabric exhibited a charred area of 40 cm², thus showing poor washing fastness.

EXAMPLE 5

A 40-count cotton poplin woven fabric was treated with each of the following treating liquors VII to X, and post-treated in the same way as in Example 1.

| Treating liquor VII (invention) | |
|---|---|
| Dimethylol glyoxal monoureine (50% aqueous solution) | 5% by weight |
| Acid catalyst (trifluoroacetic acid, 12.5% aqueous solution) | 3% by weight |
| Emulsion of copolymer A (solids content about 50%) | 5% by weight |
| Silicon emulsion (POLON MF-5, a trademark for a product of Shin-etsu Chemical Co., Ltd.) | 3% by weight |
| Water | remainder |
| **Treating liquor VIII (comparison 4)** | |
| Dimethyl glyoxal monoureine (50% aqueous solution) | 5% by weight |
| Acid catalyst (acetic acid, 80% aqueous solution) | 2% by weight |
| Emulsion of copolymer A (solids content about 50%) | 5% by weight |
| Silicone emulsion (POLON MF-5) | 3% by weight |
| Water | remainder |
| **Treating liquor IX (comparison 5)** | |
| Dimethylol glyoxal monoureine (50% aqueous solution) | 5% by weight |
| Acid catalyst (trichloroacetic acid, 25% aqueous solution) | 2% by weight |
| Emulsionn of copolymer A (solids content about 50%) | 5% by weight |
| Silicone emulsion (POLON MF-5) | 3% by weight |
| Water | remainder |

The dry and wet crease resistances, wash and wear properties and tensile strengths of the resulting fabrics were measured, and the results are shown in Table 2.

The emulsion of copolymer A used in Example 5 was prepared by emulsion polymerization at 80° to 85° C for 3 hours in a customary manner in accordance with the following recipe A.

| Recipe A | parts by weight |
|---|---|
| 2-Ethylhexyl acrylate | 25 |
| Glycidyl methacrylate | 20 |
| Polyethylene alkyl phenol ether (NONION NS-230, a trademark for a product of Nippon Oils and Fats Co., Ltd.) | 1.7 |
| Polyoxyethylene alkyl phenol ether (EMULSIT 9, a trademark for a product of Daiichi Kogyo Seiyaku Kabushiki Kaisha) | 1.7 |
| Polyethylene glycol lauryl ether (NOIGEN YX-500, a trademark for a product of Daiichi Kogyo Seiyaku Kabushiki Kaisha) | 1.7 |
| Potassium persulfate | 0.1 |
| Deionized water | 50 |

The resulting copolymer had the following characteristics.

2-Ethylhexyl acrylate unit: 49.1 mole%
Glycidyl methacrylate unit: 50.9 mole%
Molecular weight: more than 100,000
Oxirane oxygen content:
Calculated: 2.25%
Found: 2.20%
Glass transition temperatures: about −24° C.
Epoxy equivalency: 327

Table 2

| Properties / Treating liquors | Crease resistance (warp + filling) Dry | Crease resistance (warp + filling) Wet | Tensile strength (kg/5 cm) | Wash and wear properties (grade) |
|---|---|---|---|---|
| VII (invention) | 261 | 235 | 22.8 | 3.5–4 |
| VIII (comparison 4) | 223 | 221 | 19.1 | 2 |
| IX (comparison 5) | 243 | 227 | 18.3 | 3 |
| Untreated | 165 | 163 | 31.5 | 1–1.5 |

The results shown in Table 2 demonstrate that the fabric treated with treating liquor VII in accordance with the process of this invention showed a marked improvement in dry and wet crease resistances, and had superior wash and wear properties of grade 3.5 or more, and a far lower degree of strength reduction than the fabrics treated with the treating liquors of comparisons 4 and 5.

EXAMPLE 6

A 40-count cotton poplin woven fabric was treated with a treating liquor X shown below, and post-treated in the same way as in Example 1.

| Treating liquor X | |
|---|---|
| Dimethylol propyleneurea (BECKAMINE N-119, a trademark for a product of Japan Reichhold) | 15% by weight |
| Acid catalyst (trifluoroacetic acid, 12.5% aqueous solution) | 3% by weight |
| Emulsion of copolymer B (solids content about 54%) | 4% by weight |
| Silicone emulsion (NORANE SILICON 230, a trademark for a product of Japan Reichhold) | 3% by weight |
| Water | remainder |

The fabric so treated had a dry crease resistance of 281° and a wet crease resistance of 235° C. It had a tensile strength of 22.4 kg/5 cm. The untreated fabric had a dry crease resistance of 165°, a wet crease resistance of 163°, a wash and wear property of grade 1 to 1.5, and a tensile strength of 31.5 kg/5 cm. It can be seen therefore that the fabric treated by the process of this invention showed a marked improvement in crease resistance and wash and wear properties, and had a very low degree of strength reduction.

The emulsion of copolymer B used to prepare the treating liquor X was synthesized by emulsion polymerization at 80° to 85° C for 3 hours in accordance with the following recipe B.

| Receipe B | parts by weight |
|---|---|
| 2-Ethylhexyl acrylate | 35 |
| Glycidyl methacrylate | 8 |
| 2-Hydroxyethyl methacrylate | 2.5 |
| Polyoxyethylene lauryl ether | |

-continued

| Receipe B | parts by weight |
|---|---|
| sulfuric acid ester, sodium salt (TRAX K-300, a trademark for a product of Nippon Oils and Fats Co., Ltd.) | 1 |
| Polyoxyethlene alkyl phenol ether (NONION NS-230) | 7 |
| Potassium persulfate | 0.1 |
| Deionized water | 52 |

The resulting copolymer had the following properties.

Glycidyl methacrylate unit: 21.2 mole%
Molecular weight: 50,000 to 100,000
Glass transition temperature: about −55° C.
Epoxy equivalency: 831
Oxirane oxygen content:
Found: 0.83%
Calculated: 0.85%

EXAMPLE 7

A 4-count cotton poplin woven fabric was treated by the same procedure as in Example 6 except that an emulsion of copolymer C (silids content, about 50%) was used instead of the emulsion of copolymer B in preparing the treating liquor X.

The fabric treated had a dry crease resistance of 273 °, a wet crease resistance of 231°, a wash and wear property of grade 5, and a tensile strength of 22.7 kg/5 cm, showing superior crease resistances and wash and wear properties.

The emulsion of copolymer C was prepared by emulsion polymerization at 80° to 85° C for 3 hours in accordance with the following recipe C.

| Recipe C | parts by weight |
|---|---|
| 2-Ethylhexyl acrylate | 15.2 |
| Glycidyl methacrylate | 10.0 |
| Methyl methacrylate | 21.0 |
| Polyethylene alkyl phenol ether (NONION NS-230) | 1.7 |
| Polyoxyethylene alkyl phenol ether (EMULSIT 9) | 1.7 |
| Polyethylene glycol lauryl ether (NOIGEN YX-500) | 1.7 |
| Polyoxyethylene lauryl ether sulfuric acid ester, sodium salt (TRAX K-300) | 0.5 |
| Potassium persulfate | 0.1 |
| Deionized water | 48.1 |

The resulting copolymer had the following properties.

Glycidyl methacrylate unit: 19.2 mole%
Molecular weight: 50,000 to 100,000
Glass transition point: about 17° C
Epoxy equivalency: 711
Oxirane oxygen content:
Found: 1.04%
Calculated: 1.12%

EXAMPLE 8

A 40-count cotton poplin woven fabric was dipped in each of the following treating liquors XI, XII, XIII, XIV, XV and XVI, withdrawn from the bath, squeezed to a pickup of 70% based on the weight of the fabric, pre-dried at 120° C for 3.5 minutes, and then heat-treated at 155° C for 3 minutes.

| | |
|---|---|
| **Treating liquor XI (invention)** | |
| 1,3-Dimethyl-4,5-dihydroxy-2-imidazolidinone (50% aqueous solution) | 20 by weight |
| Trifluoroacetic acid (12.5% aqueous solution) | 2% by weight |
| Polyethylene emulsion (MEIKATEX PEN) | 2% by weight |
| Water | remainder |
| **Treating liquor XII (comparison 6)** | |
| Partially methoxy-substituted methylol-4,5-dihydroxy-2-imidazolidinone (SUMITEX RESIN NS-11, a trademark for a product of Sumitomo Chemical Co., Ltd.) | 5% by weight |
| Metal salt catalyst (main ingredient: magnesium chloride; ACCELERATOR MX) | 1.5% by weight |
| Polyethylene emulsion (MEIKATEX PEN) | 2% by weight |
| Water | remainder |
| **Treating liquor (XIII) (comparison 7)** | |
| 1,3-Dimethyl-4,5-dihydroxy-2-imidazolidinone (50% aqueous solution) | 20 by weight |
| Metal salt catalyst (main ingredient: magnesium chloride; ACCELERATOR MX) | 6% by weight |
| Polyethylene emulsion (MEIKATEX PEN) | 2% by weight |
| Water | remainder |
| **Treating liquor XIV (comparison 8)** | |
| 1,3-Dimethyl-4,5-dihydroxy-2-imidazolidinone (50% aqueous solution) | 20% by weight |
| Metal salt catalyst (main ingredient, zinc borofluoride; ACCELERATOR X-90, a trademark for a product of Sumitomo Chemical Co., Ltd.) | 2% by weight |
| Polyethylene emulsion (MEIKATEX PEN) | 2% by weight |
| Water | remainder |
| **Treating liquor XV (comparison 9)** | |
| 1,3-Dimethyl-4,5-dihydroxy-2-imidazolidinone (50% aqueous solution) | 20% by weight |
| Acetic acid (80% aqueous solution) | 2% by weight |
| Polyethylene emulsion (MEIKATEX PEN) | 2% by weight |
| Water | remainder |
| **Treating liquor XVI (comparison 10)** | |
| 1,3-Dimethyl-4,5-dihydroxy-2-imidazolidinone (50% aqueous solution) | 20% by weight |
| Trichloroacetic acid (25% aqueous solution) | 1% by weight |
| Polyethylene emulsion (MEIKATEX PEN) | 2% by weight |
| Water | remainder |

The dry and wet crease resistances, wash and wear properties, tensile strengths, residual formaldehyde contents and odors of the fabrics so treated were determined, and the results are shown in Table 3.

Table 3

| Properties / Treating liquors | Crease resistance (warp + filling) Dry | Crease resistance (warp + filling) Wet | Tensile strength (kg/5 cm) (filling) | Wash and wear properties (grade) | Odor of the treated fabric | Amount of residual formaldehyde in treated fabric (ppm) |
|---|---|---|---|---|---|---|
| XI (invention) | 259 | 228 | 23.3 | 3.5–4 | None | Not detected |
| XII | 245 | 214 | 18.1 | 3–3.5 | Odor of | 358 |

Table 3-continued

| Properties / Treating liquors | Crease resistance (warp + filling) Dry | Wet | Tensile strength (kg/5 cm) (filling) | Wash and wear properties (grade) | Odor of the treated fabric | Amount of residual formaldehyde in treated fabric (ppm) |
|---|---|---|---|---|---|---|
| (comparison 6) | | | | | | |
| XIII (comparison 7) | 225 | 205 | 21.0 | 2.5 | formaldehyde peculiar garlic-like odor | Not detected |
| XIV (comparison 8) | 237 | 212 | 19.8 | 2.5–3 | Some amine-like odor | Not detected |
| XV (comparison 9) | 208 | 198 | 16.5 | 1.5 | Some acetic acid odor | Not detected |
| XVI (comparison 10) | 231 | 209 | 17.1 | 2.5 | Very strong irritating odor | Not detected |
| Untreated | 165 | 163 | 36.5 | 1–1.5 | None | Not detected |

The following conclusion can be drawn from the result shown in Table 3.

The fabric treated by the method of this invention (treating liquor XI) showed a marked improvement in dry and wet crease resistances and wash and wear properties and its reduction in strength was very little. Furthermore, no offensive odor came off from the treated fabric, and no residual formaldehyde was detected.

The fabric treated by the treating liquor of comparison 6 showed a marked improvement in crease resistances and wash and wear properties. But the treated fabric gave off a formaldehyde odor, and its strength was greatly reduced.

The fabric treated by the treating liquor of comparison 7 gave off a peculiar odor, and was found undesirable for consumer goods.

The fabric treated with the treating liquor of comparison 8 had a reduced odor and showed a marked improvement in crease resistances, but its strength was reduced greatly.

The fabric treated with the treating liquor of comparison 9 gave off a strong acetic acid-like odor, and the finishing effect was insufficient.

In comparison 10, the irritating odor was generated during finishing operation, and also from the fabric treated. Furthermore, its strength was reduced greatly.

Thus, the product in accordance with this invention has superior crease resistances and wash and wear properties with little reduction in strength. Furthermore, since no offensive odor was generated from the treated fabric, a soaping step can be omitted, and the overall process can be simplified.

EXAMPLE 9

A plain knitted cotton fabric which has been scoured, bleached and mercerized in a customary manner was dipped in each of the same treating liquors XI, XII, XIII, DIV, XV and XVI as used in Example 8, withdrawn from the bath, squeezed to a pickup of 75% based on the weight of the knitted fabric, pre-dried under no tension in a cylindrical dryer, and then heat-treated at 180° C for 1 minute while it was being pin-tentered 15% in the filling direction.

The properties of the knitted fabrics so treated were determined, and the results are shown in Table 4.

Table 4

| Properties / Treating liquors | Shrinking on washing (%) Warp | Filling | Tensile strength in the filling direction (kg/2.5 cm) | Odor of the treated fabric | Amount of residual formaldehyde (ppm) |
|---|---|---|---|---|---|
| XI (invention) | 2.0 | 4.8 | 17.5 | None | Not detected |
| XII (comparison 6') | 2.8 | 5.5 | 13.8 | Strong formaldehyde odor | 525 |
| XIII (comparison 7') | 7.2 | 9.4 | 15.6 | Strong odors of garlic and acetylene gas | Not detected |
| XIV (comparison 8') | 6.3 | 8.6 | 14.2 | Some amine-like odor | Not detected |
| XV (comparison 9') | 9.4 | 10.1 | 13.3 | Acetic acid odor | Not detected |
| XVI (comparison 10') | 6.5 | 8.7 | 13.5 | Strong irritating odor | Not detected |
| Untreated | 10.5 | 14.7 | 18.3 | None | Not detected |

The following conclusion can be drawn from the results shown in Table 4.

The knitted fabric treated by the process of this invention had a further improved shrinkage on washing, and a very little reduction in tensile strength, as compared with the comparison 6'. No formaldehyde was detected, and no offensive odor was given off from the treated fabric.

The fabric treated with the treating liquor of comparison 7' had a fairly low degree of strength reduction, and no formaldehyde was detected. But it has insufficient shrinkages on washing, and the treated fabric gave off a peculiar odor like acetylene gas.

In comparison 8', the odor from the treated fabric was less than in comparison 7', but the strength of the fabric was reduced greatly.

The fabrics treated in comparisons 9' and 10' had far higher shrinkages on washing than the fabric treated by the process of this invention, and their strength was considerably reduced. Furthermore, the treated fabrics gave off an offensive odor.

EXAMPLE 10

A mix-woven fabric of 65% Tetoron polyester and 35% cotton was treated with the same treatinf liquor XI as used in Example 8, and then post-treated in the same way as in Example 8. The fabric so treated had a dry crease resistance (warp + filling) of 290°, while the untreated fabric had a dry crease resistance of 250°. The treated fabric was found to be free of offensive odors like the untreated fabric.

EXAMPLE 11

A rayon woven fabric was treated with the same treating liquor XI as used in Example 8, and then post-treated in the same way in Example 8. The treated fabric had a dry crease resistance (warp + filling) of 255°, while before treatment, it had a dry crease resistance of 163°. No offensive odor was generated from the treated fabric.

EXAMPLE 12

The pH of the treating liquor XI was measured, and found to be 2. The treating liquor was divided into two portions. Ammonium tartrate was added to the one portion to adjust its pH to 3.5. To the other was added diammonium phosphate to adjust the pH of the liquor to 6.5.

A 40-count cotton poplin woven fabric was dipped in each of the treating liquors having a pH of 3.5 and 6.5, respectively, and then post-treated in the same way as in Example 8.

The fabric treated with the treating liquor with a pH of 3.5 had a dry crease resistance (warp + filling) of 260°, while the fabric treated with the treating liquor with a pH of 6.5 had a dry crease resistance of 250°. Neither of these treated fabrics gave off an offensive odor.

When the same fabric as set forth above was first dyed with a reactive dye, and then treated with each of the two treating liquors set forth above. The treated fabrics had good dyeing fastness characteristics such as fastness to sunlight and fastness to rubbing, and no discoloration of the dye was observed.

EXAMPLE 13

A 40-count cotton poplin woven fabric was dipped in each of the following treating liquors XVII, XVIII, XIX, and XX, and treated in the same way as in Example 8.

| Treating liquor VXII (invention) | |
|---|---|
| 1,3-Dimethyl-4,5-dihydroxy-2-imidazolidinone (50% aqueous solution) | 30% by weight |
| Trifluoroacetic acid (12.5% aqueous solution) | 4% by weight |
| Emulsion of copolymer A (solids content about 50% | 5% by weight |
| Polyethylene emulsion (MEIKATEX PEN) | 2% by weight |
| Water | remainder |
| **Treating liquor XVIII (invention)** | |
| 1,3-Dimethyl-4,5-dihydroxy-2-imidazolidinone (50% aqueous solution) | 30% by weight |
| Trifluoroacetic acid (12.5% aqueous solution) | 3% by weight |
| Zinc chloride (25% aqueous solution) | 0.5 by weight |
| Emulsion of copolymer A (solids content, about 50%) | 5% by weight |
| Polyethylene emulsion (MEIKATEX PEN) | 2% by weight |
| Water | remainder |
| **Treating liquor XIX (comparison 11)** | |
| 1,3-Dimethyl-4,5-dihydroxy-2-imidazolidinone (50% aqueous solution) | 30% by weight |
| Trichloroacetic acid (25% aqueous solution) | 2% by weight |
| Emulsion of copolymer A (solids content, about 50%) | 5% by weight |
| Polyethylene emulsion (MEIKATEX PEN) | 2% by weight |
| Water | remainder |
| **Treating liquor XX (comparison 12)** | |
| 1,3-Dimethyl-4,5-dihydroxy-2-imidazolidinone (50% aqueous solution) | 30% by weight |
| Acetic acid (80% aqueous solution) | 2% by weight |
| Emulsion of copolymer A (solids content, about 50%) | 5% by weight |
| Polyethylene emulsion (MEIKATEX PEN) | 2% by weight |
| Water | remainder |

The dry and wet crease resistances, wash and wear properties, tensile strengths and odors of the fabrics so treated were determined, and the results are shown in Table. 5.

Table 5

| Properties / Treating liquors | Crease resistance (warp + filling) Dry | Crease resistance (warp + filling) Wet | Tensile strength (kg/5 cm) | Wash and wear properties (grade) | Odor of the treated fabric |
|---|---|---|---|---|---|
| XVII (invention) | 296 | 268 | 22.5 | 5 | None |
| XVIII (invention) | 303 | 274 | 20.9 | 5 | None |
| XIV (comparison 11) | 251 | 246 | 17.9 | 3–3.5 | Strong irritating odor |
| XX (comparison 12) | 238 | 235 | 18.5 | 2.5–3 | Some acetic acid odor |
| Untreated | 165 | 163 | 31.5 | 1–1.5 | None |

The following conclusion can be drawn from the results shown in Table 5.

The fabrics treated with the treating liquors XVII and XVIII in accordance with the process of this invention had very superior dry and wet crease resistances and wash and wear properties, and showed an extremely low degree of strength reduction. Furthermore, no offensive odor from the treated fabrics was detected.

On the other hand, the fabrics treated with the treating liquors of comparisons 11 and 12 had lower crease resistances and wash and wear properties, and showed a high degree of strength reduction. Furthermore, offensive odors were generated from the treated fabrics.

EXAMPLE 14

A non-woven web of 100% rayon with a basis weight of 60 g/m² was placed on a wire gauze-type belt, dipped in the following treating liquor XXI, squeezed to a pickup of 150% based on the weight of the web, pre-dried at 120° C for 4 minutes, and then heat-treated at 155° C for 3.5 minutes. The non-woven fabric so treated had a dry crease resistance (wrap + filling) of 315°.

The non-woven fabric was washed in a home washer at 40° C for 15 minutes using a 0.2% aqueous solution of a household detergent (ZABU) and its resistance to washing and examined. There was no change in its dimension, and after washing, the fabric had a dry crease resistance (warp + filling) of 312°.

| Treating liquor XXI (invention) | |
|---|---|
| 1,3-Dimethyl-4,5-dihydroxy-2-imidazolidinone (about 50% aqueous solution) | 10% by weight |
| Emulsion of copolymer A (solids content about 50%) | 65% by weight |
| Trifluoroacetic acid (12.5% aqueous solution) | 2% by weight |
| Zinc chloride (25% aqueous solution) | 1% by weight |
| Water | remainder |

EXAMPLE 15

A plain-knitted cotton fabric which has been scoured, bleached and mercerized in a customary manner was dipped in each of the following treating liquors XXII, XXIII and XXIV, and post-treated in the same way as in Example 9

| Treating liquor XXII (invention) | |
|---|---|
| Emulsion of copolymer B (solids content, about 54%) | 10% by weight |
| Trifluoroacetic acid (12.5% aqueous solution) | 2% by weight |
| Silicone emulsion (POLON MF, a trademark for a product of Shin-etsu Chemical Co., Ltd.) | 3% by weight |
| Water | remainder |
| **Treating liquor XXIII (comparison 13)** | |
| Emulsion of copolymer B (solids content, about 54%) | 10% by weight |
| Acetic acid (80% aqueous solution) | 2% by weight |
| Silicon emulsion (POLON MF-5) | 3% by weight |
| Water | remainder |
| **Treating liquor XXIV (comparison 14)** | |
| Emulsion of copolymer B (solids content, about 54%) | 10% by weight |
| Trichloracetic acid (25% aqueous solution) | 1% by weight |
| Silicon emulsion (POLON MF-5) | 3% by weight |
| Water | remainder |

The shrinkages on washing, tensile strengths and odors of the knitted fabrics treated were determined, and the results are shown in Table 6.

Table 6

| Properties / Treating liquors | Shrinkage on washing (%) Warp | Shrinkage on washing (%) Filling | Tensile strength in the filling direction (kg/2.5 cm) | Odor of the treated fabric |
|---|---|---|---|---|
| XXII (invention) | 2.3 | 5.1 | 20.5 | None |
| XXIII (comparison 13) | 8.7 | 9.5 | 15.8 | Acetic acid odor |
| XXIV (comparison 14) | 6.2 | 9.1 | 17.4 | Strong irritating odor |
| Untreated | 10.5 | 14.7 | 18.3 | None |

It can be seen from Table 6 that the knitted fabric treated by the process of the invention showed a superior shrinkage resistance on washing, and had a higher strength than the untreated fabric, whereas the fabrics treated with the treating liquors of comparisons 13 and 14 showed a high degree of strength reduction and a high shrinkage on washing, and also gave off offensive odors.

EXAMPLE 16

A 40-count cotton poplin woven fabric was dipped in the following treating liquor XXV, and post-treated in the same way as in Example 8.

| Treating liquor XXV | |
|---|---|
| 1,3-Dimethyl-4,5-dihydroxy-2-imidazolidinone (50% aqueous solution) | 25% by weight |
| Trifluoroacetic acid (12.5% aqueous solution | 3% by weight |
| Emulsion of copolymer C (solids content, about 50%) | 5% by weight |
| Polyethylene emulsion (MEIKATEX PEN) | 3% by weight |
| Water | remainder |

The dry and wet crease resistances of the fabric treated were 267°, and 239°, respectively. Its tensile strength was 22.8 kg/5 cm, and its wash and wear property was rated as grade 4. The untreated fabric had a dry crease resistance of 165°, a wet crease resistance of 163°, a wash and wear property of grade 1 to 1.5, and a tensile strength of 31.5 kg/cm.

It can thus be seen that the fabric treated in accordance with this invention had markedly improved crease resistances and wash and wear properties, and a very low degree of strength reduction. In addition, no generation of offensive odors from the treated fabric was detected.

EXAMPLE 17

A cotton satin dyed fabric was dipped in the same treating liquor XXV as used in Example 16, withdrawn from the bath, squeezed to a pickup of 70% based on the weight of the fabric, pre-dried at 110° C for 3 minutes, and then dampened to a moisture content of 13 to 15%. Then, it was embossed in a sakker-like pattern, and then heat-treated at 155° C for 3 minutes.

The fabric so treated was soaped with a 0.1% aqueous solution of a detergent (NEW BEADS) at 60° C for 30 minutes. The shape of the treated fabrics before and after the soaping treatment were compared, and it was found that the treated fabric showed a very good shape retention after the soaping.

What we claim is:

1. In a process for modifying a fibrous product containing cellulosic fibers, by impregnating said fibrous product with a treating liquor containing a chemical textile finishing agent, and then heat-treating the impregnated fabric in the presence of an acid catalyst, the improvement which comprises using as said acid catalyst a fluorocarboxylic acid of the formula $$C_nF_pH_qCOOH$$

wherein $n$ is an integer of 1 to 5, $p$ is 2 to 10, and $q$ is 0 or 1, with the proviso that the sum of $p$ and $q$ equals $2n + 1$ the amount of said fluorocarboxylic acid being 0.01 to 1.5% by weight based on the weight of the treating liquor.

2. The process of claim 1 wherein said fluorocarboxylic acid is selected from the group consisting of $CF_3COOH$, $CF_2HCCOH$, $C_2F_5COOH$, $C_2F_4HCOOH$, $C_3F_7COOH$, $C_3F_6HCOOH$, $C_4F_9COOH$, $C_4F_8HCOOH$, $C_5F_{11}COOH$ and $C_5F_{10}HCOOH$.

3. The process of claim 1 wherein said fluorocarboxylic acid is trifluoroacetic acid.

4. The process of claim 1 wherein said fluorocarboxylic acid is present in the treating liquor.

5. The process of claim 1 wherein said fluorocarboxylic acid is used in an amount of 0.1 to 10% by weight, based on the chemical finishing agent.

6. The process of claim 1 wherein said fluorocarboxylic acid is present in the treating liquor in a concentration of 0.05 to 0.5% by weight based on the weight of the treating liquor.

7. The process of claim 1 wherein said fluorocarboxylic acid is used in an amount of 0.05 to 15% by weight, based on the chemical textile finishing agent.

8. The process of claim 1 wherein said chemical textile finishing agent is an N-methylol compound or its functional derivatives.

9. The process of claim 1 wherein said chemical textile finishing agent is a film-forming glycidyl-containing thermoplastic polymer.

10. The process of claim 1 wherein said chemical textile finishing agent consists of an N-methylol compound or its functional derivative and a film-forming glycidyl-containing thermoplastic polymer.

11. The process of claim 1 wherein said chemical textile finishing agent consists of an imidazolidinone derivative of the following formula

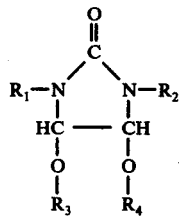

wherein $R_1$ and $R_2$, independently from each other, represent a hydrogen atom, an alkyl group, or an alkyl group substituted with a hydroxyl, cyano, carboxyl, lower alkoxy carbonyl or carbamoyl group, and $R_3$ and $R_4$, independently from each other, represent a hydrogen atom, an alkyl group, or an acyl group, or both said imidazolidinone derivative and a film-forming glycidyl-containing thermoplastic polymer.

* * * * *